US006389784B1

(12) United States Patent
Siddoway

(10) Patent No.: US 6,389,784 B1
(45) Date of Patent: May 21, 2002

(54) CINCH

(76) Inventor: Brett L. Siddoway, 4815 W. 100 South, Hooper, UT (US) 84315

( * ) Notice: Subject to any disclaimer, the term of this patent is extended or adjusted under 35 U.S.C. 154(b) by 0 days.

(21) Appl. No.: 09/602,942

(22) Filed: Jun. 26, 2000

(51) Int. Cl.[7] ..... B68C 1/14
(52) U.S. Cl. ..... 54/23
(58) Field of Search ..... 54/23, 44.1, 44.3, 54/46.1, 44.5; 119/856, 792

(56) References Cited

U.S. PATENT DOCUMENTS 3,828,521 A * 8/1974 Dulaney ..... 54/23
4,434,604 A * 3/1984 Bird ..... 54/23
5,426,924 A * 6/1995 Harty ..... 54/23
5,566,533 A * 10/1996 Larisch ..... 54/23
5,743,072 A * 4/1998 Chang ..... 54/23
5,768,864 A * 6/1998 Chang ..... 54/23
5,946,892 A * 9/1999 Siddoway ..... 54/23
6,220,003 B1 * 4/2001 Hung ..... 54/23

* cited by examiner

*Primary Examiner*—Charles T. Jordan
*Assistant Examiner*—Yvonne R. Abbott

(57) ABSTRACT

An improved cinch for use with animals comprising a heat and pressure molded animal engaging strap having spaced apart lands with curved outer edges projecting from a base and grooves between the lands, a buckle strap, and a fastener to hold the buckle strap in place against the animal engaging strap.

5 Claims, 6 Drawing Sheets

CINCH

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

PRIOR ART

Figure 1:
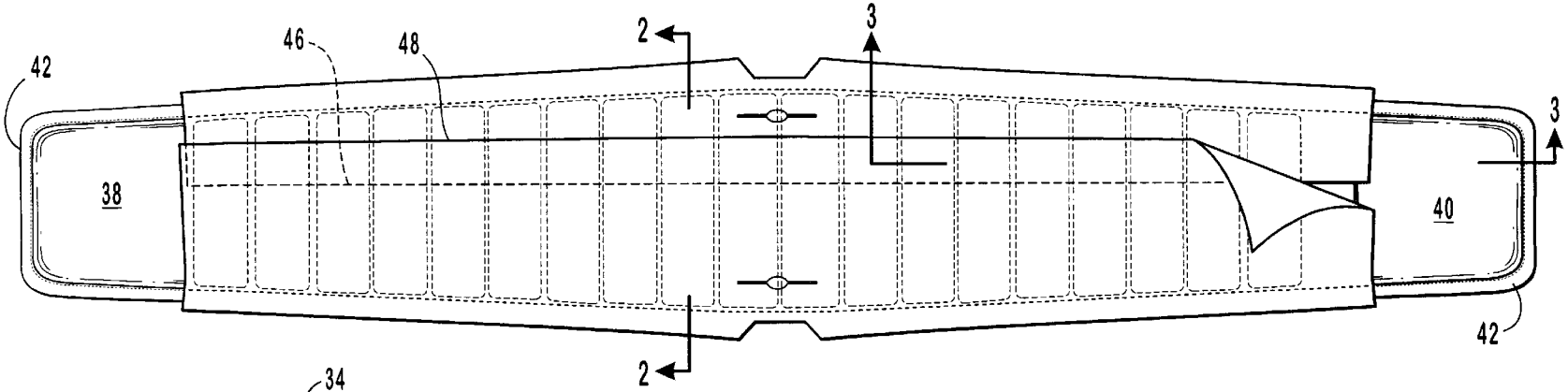

U.S. Pat. No. 5,946,892, issued Sep. 7, 1999

BACKGROUND OF THE INVENTION

This invention relates to cinches that pass beneath the belly of an animal such as a horse, mule, llama, etc. to secure a riding saddle or pack frame on the animal.

Riding saddles for people and pack frames to carry loads have long been secured to animals using cinches that extend from the saddle or frame beneath the belly of the animal and that are then pulled tight to secure the saddle or frame in place on the animal. The cinch must be pulled sufficiently tight that when a person sits on the saddle or a load is tied to the frame the saddle or frame will not slip, turn on the animal and discharge the rider or load during movement of the animal.

U.S. Pat. No. 5,546,232 discloses a cinch that provides greater comfort, as compared to the usual leather or canvas strap cinches previously used, for an animal on which the cinch is secured. It has been found, however, that the cinch of U.S. Pat. No. 5,946,892 has sewn seams and connected edges that will chafe an animal. Further, the manner in which the cinch of the aforesaid patent is constructed makes the cinch more expensive to construct than is desired.

OBJECTS OF THE INVENTION

Principal objects of the present invention are to provide an improved cinch that will be more comfortable to an animal on which the cinch is used and to provide a method of making such a cinch that significantly reduces the production cost of such a cinch.

FEATURES OF THE INVENTION

Principal features of the invention include a method of construction of a cinch that includes heat stamping an elongate animal engaging strap from a suitable foam material such that a durable, smooth skin is formed on one animal contact surface of the animal engaging strap and flexure grooves separating curved edge lands are formed between adjacent grooves on the contact surface. Flanges are molded at opposite sides of the elongate animal engaging strap and securement means are sewn or otherwise secured to the flanges to hold a buckle strap in place against the other face of the animal engaging strap. The securement means is folded over the seam formed by connection of the securement means to the flanges of the animal engagement strap so that no exposed seam is presented to engage and chafe an animal with which the cinch is used. Opposite ends of the animal engaging straps are formed to accommodate buckles at opposite ends of the buckle strap.

The securement means may comprise overlapping flaps to extend over the buckle strap and to be secured together along their lengths. In another embodiment, the securement means may comprise an elastic sleeve into which the buckle strap is inserted.

Other objects and features of the invention will become apparent to those skilled in the art to which the invention pertains from the following detailed description and drawings, disclosing what is presently contemplated as being the best mode of the invention.

DRAWINGS

Figure 3:
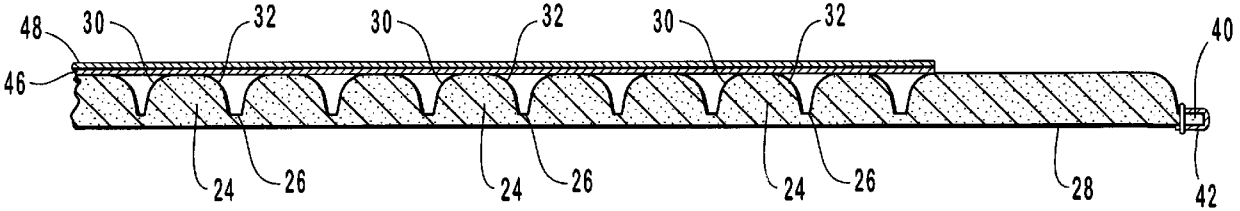
Figure 2:
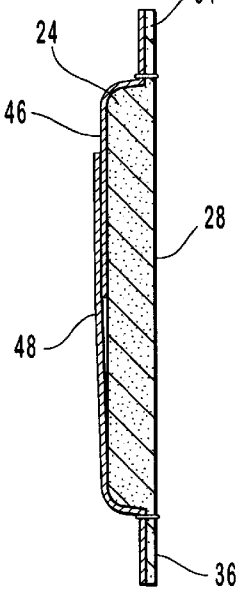
Figure 4:
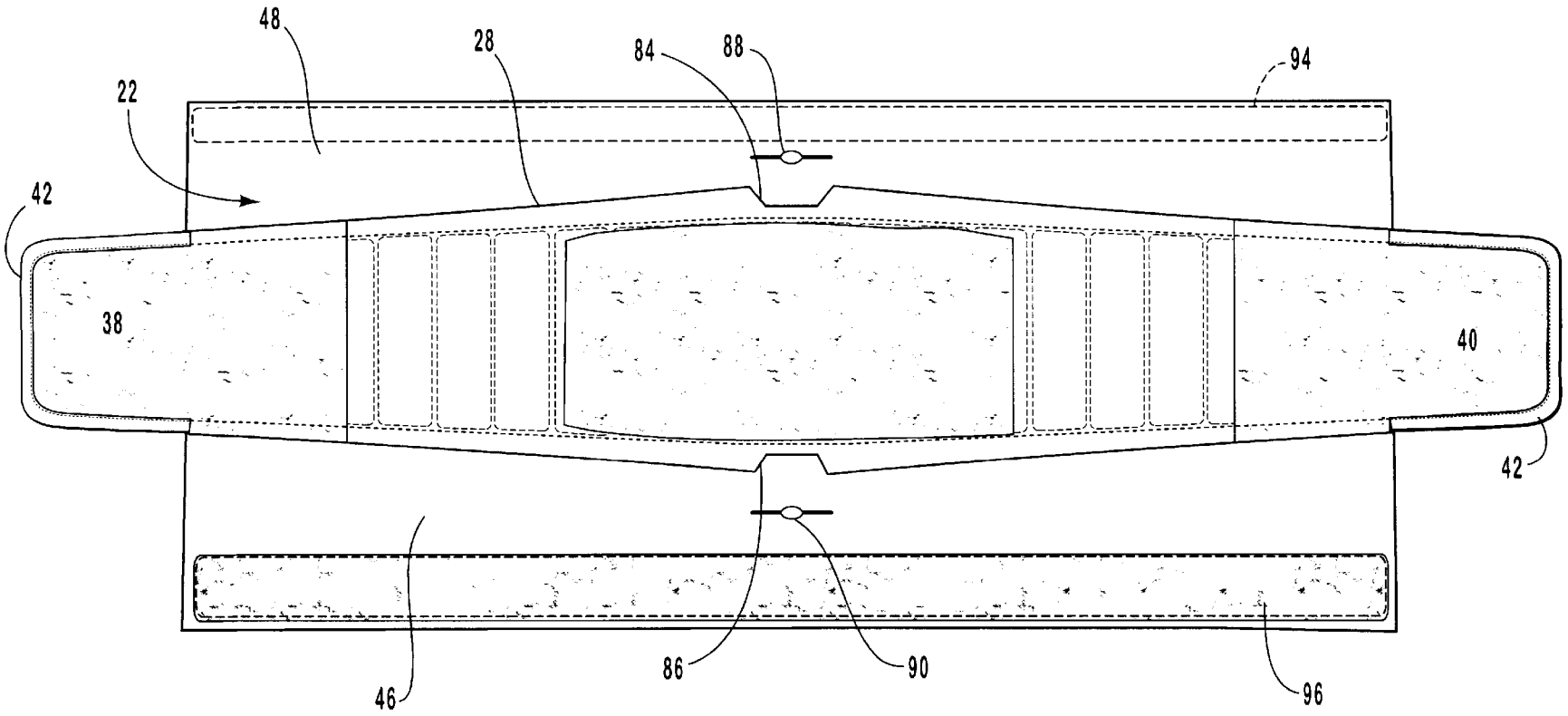
Figure 5:
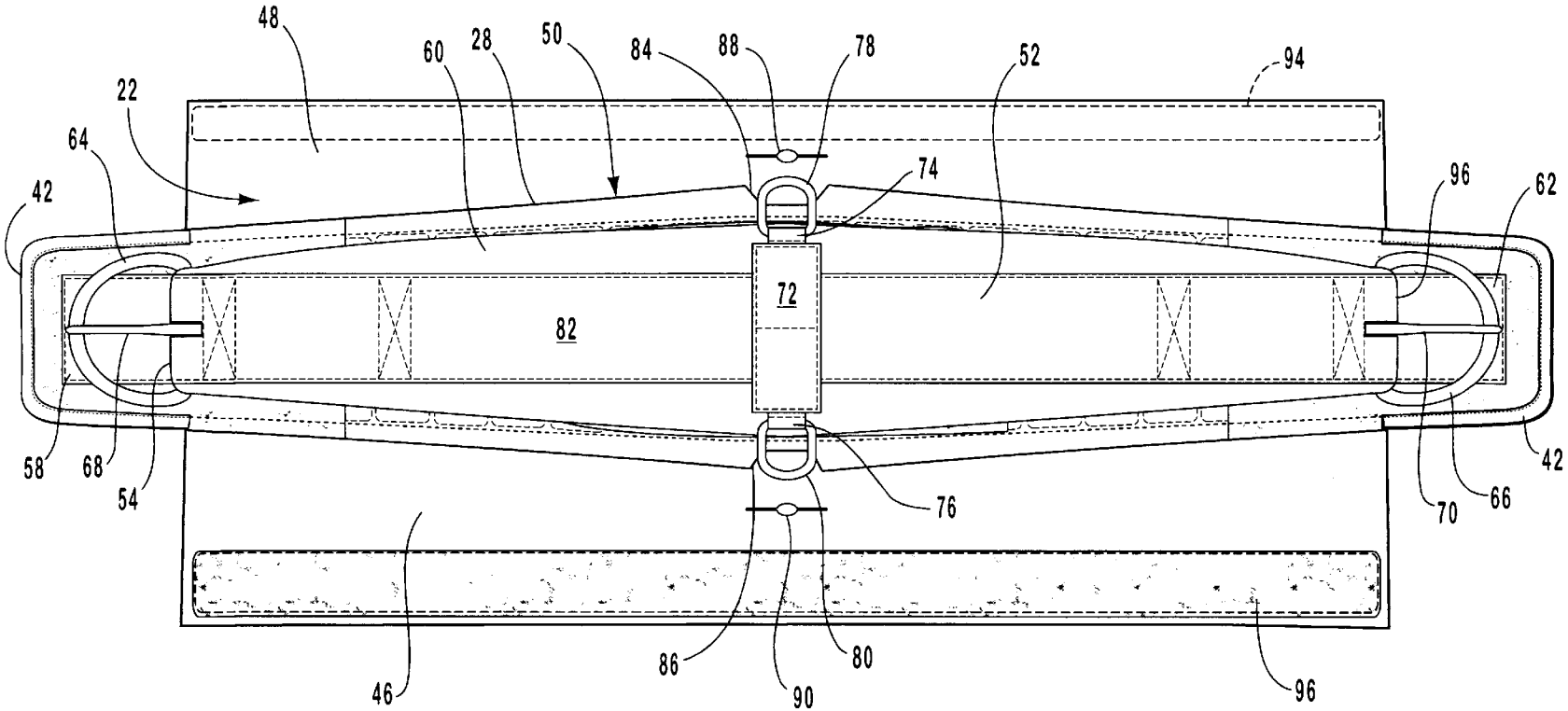
Figure 6:
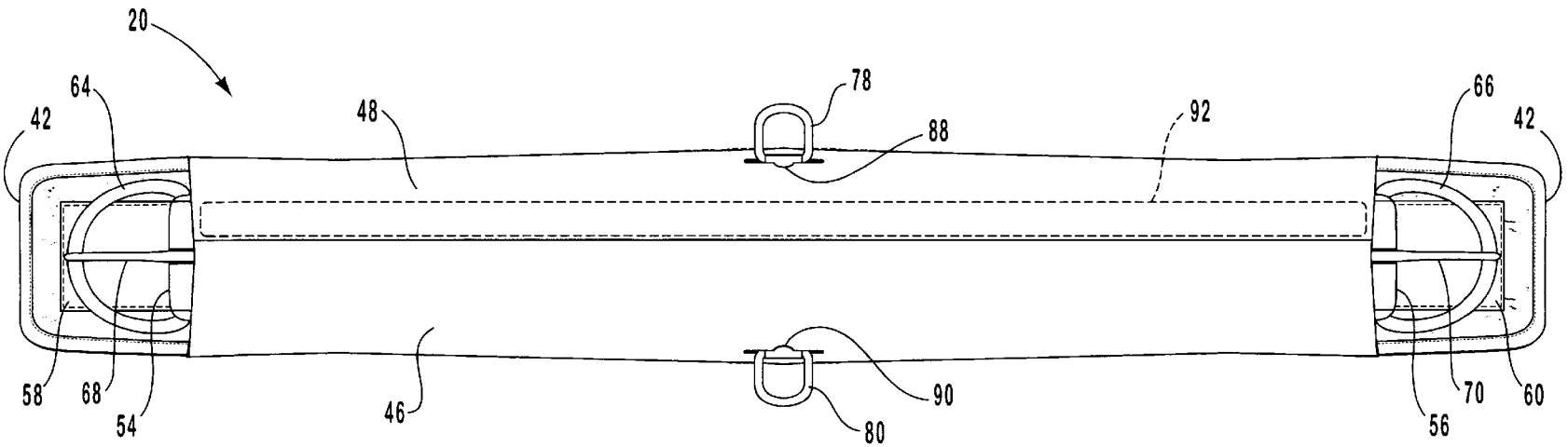
Figure 7:
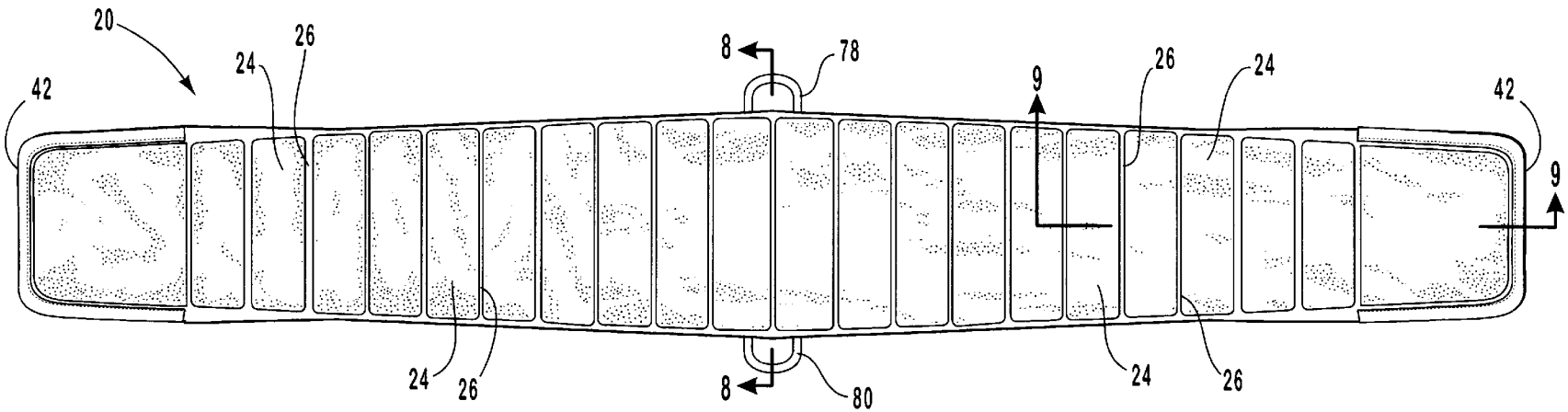
Figure 8:
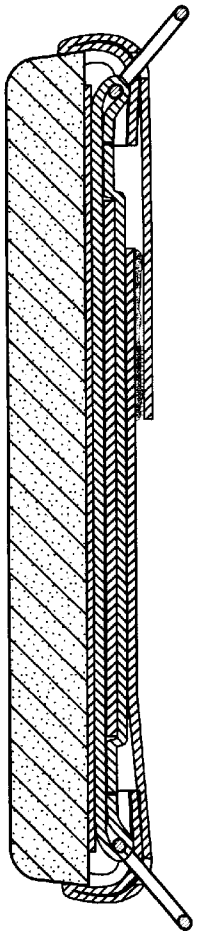

In the drawings:

FIG. 1 is a top plan view of the animal engagement strap and attached securement means of the cinch of the invention;

FIG. 2, an enlarged vertical section, taken on the line 2—2 of FIG. 1;

FIG. 3, a vertical section, taken on the line 3—3 of FIG. 1;

FIG. 4, a bottom plan view of the animal engagement strap and attached securement means;

FIG. 5, the animal engagement strap as shown in FIG. 4, but with the buckle strap positioned thereon;

FIG. 6, a view like that of FIG. 5, but with the securement means holding the buckle strap in place to form the cinch of the invention;

FIG. 7, a top plan view of the cinch of the invention;

FIG. 8, an enlarged vertical section, taken on the line 8—8 of FIG. 7

Figure 9:
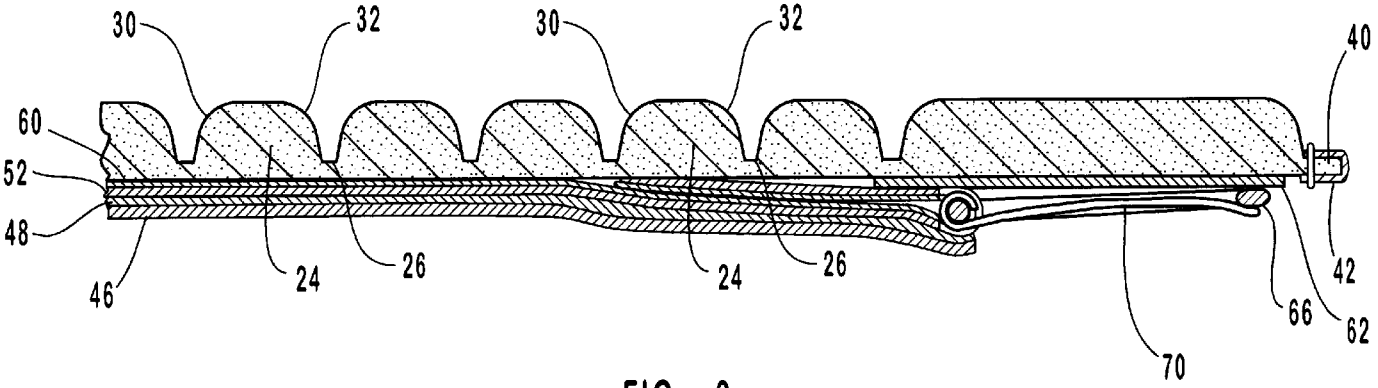
Figure 10:
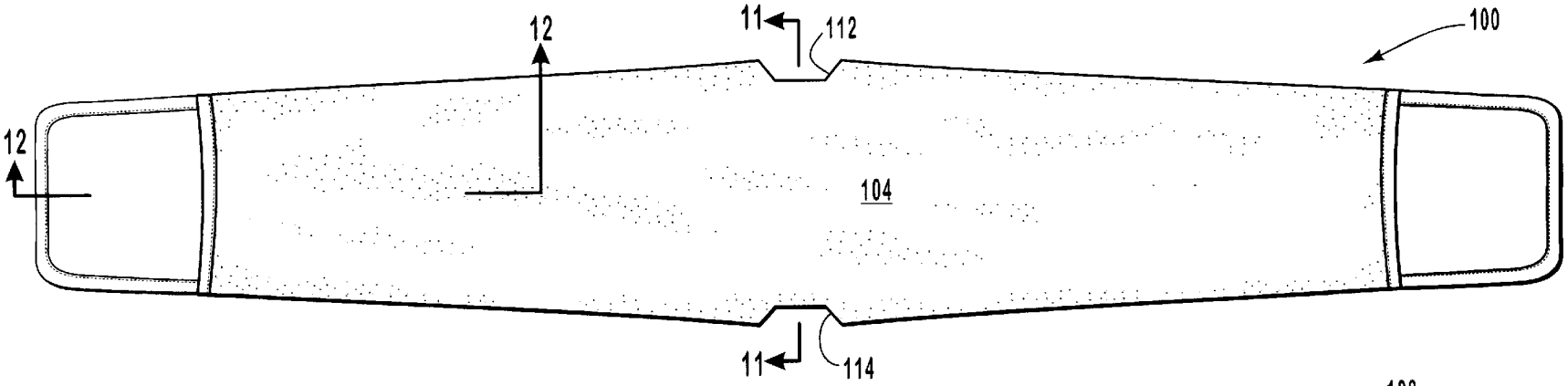
Figure 11:
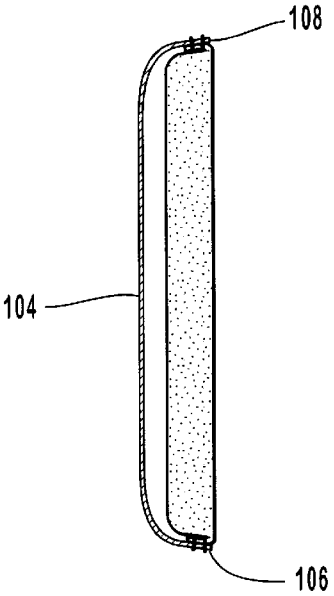
Figure 12:
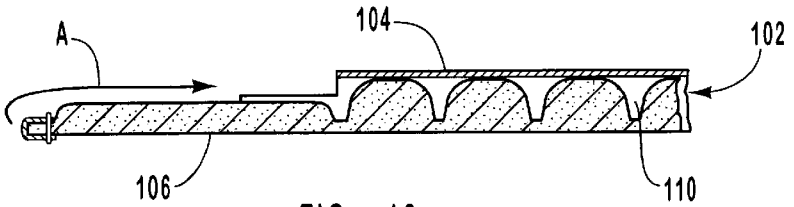

FIG. 9, a vertical section taken on the line 9—9 of FIG. 7;

FIG. 10 a view like that of FIG. 6, but with another embodiment of securement means:

FIG. 11, a vertical section taken on the line 11—11 of FIG. 10;

FIG. 12, a vertical section taken on the line 12—12 of FIG. 10, and

Figure 13:
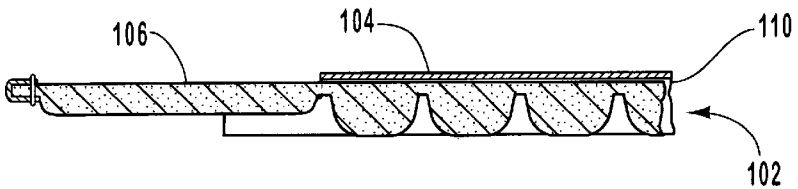

FIG. 13, a view like that of FIG. 12, but turned inside out.

DETAILED DESCRIPTION

Referring now to the drawings:

In the illustrated preferred embodiment of FIGS. 1–9 the improved cinch is shown generally at 20, FIG. 6. The improved cinch includes an animal engagement strap 22 formed from a pressure molded, somewhat resilient piece of a suitable strong plastic material having spaced apart lands and grooves 24 and 26, respectively, on a top face thereof. Each of the lands 24 projects from a base 28 and the grooves 26 are the spaces formed between adjacent lands. The lands extend transversely across the animal engagement strap and the outermost edges 30 and 32 of each land are curved or angled so that when the animal engagement strap is placed beneath the belly of an animal and curved to fit the animal the outermost edges of the lands will remain separated or will engage one another without pinching the animal hide between lands. It has been found that if the plastic material is subjected to a hot molding process wherein the mold used has adjacent projections to compress the plastic between lands the pressure of the mold and the applied heat will permanently deform the plastic and will form a tough skin on the surface of the plastic to which the pressure and heat is applied. When the animal engaging strap is positioned beneath the belly of an animal and is curved against the animal the grooves 26 will allow air to the belly of the animal and perspiration to be carried away from the animal.

The molded animal engagement strap 22 is elongate and has flared peripheral edges 34 and 36 extending along opposite sides thereof, adjacent to the ends of the lands 24 and grooves 26. Flat areas 38 and 40 are molded at opposite ends of the animal engagement strap and an edging band 42 is sewn around the peripheral edges of each flat area.

Securement flaps 46 and 48 are respectively sewn to the peripheral edges 34 and 36, which form extensions of the base 28. The flaps 46 and 48 are sewn to peripheral edges 34 and 36 of the base 28 on the top face of the base and are turned back with the edges 34 and 36 to extend across the bottom of the base 28 of the animal engagement strap 22. The edging band 42 and turned back securement flaps 46 and 48 provide smooth edges that will prevent some chafing of an animal on which the improved cinch is used.

A buckle strap, shown generally at 50, is made of a suitably strong material such as woven nylon. Buckle strap 50 includes an elongate backing strap 52 turned back to form loops in the opposite ends 54 and 56. A reinforcement strap 60 is sewn to backing strap 52 and pads 58 and 62, at opposite ends of the buckle strap are sewn to the backing strap and extend beyond the ends of the backing strap.

Buckles 64 and 66 are respectively held in place by the loops at ends 58 and 62 with buckle tongues 68 and 70 extending through the loops and the buckles resting on the pads 58 and 62. A strap 72 extends transversely across the backing strap intermediate the length of the backing strap and has loops 74 and 76 at opposite ends thereof to hold rings 78 and 80 in place. Strap 72 is sewn to the backing strap and is additionally held in place by an overlay strap 82 that is sewn to both the backing strap 50 and the transversely extending strap 72.

Cinch 20 is assembled by positioning buckle strap 50 against the bottom of the base 28 of the animal engaging strap 22 and with the pads 56 and 58 against the flat areas 38 and 40. The flaps 46 and 48 are then folded over the buckle strap 50, pulling the peripheral edges 32 and 34 over the edges of the buckle strap and with the rings 78 and 80 extending through notches 84 and 86 in the peripheral edges and slots 89 and 90 formed in the flaps 48 and 46 respectively. The flaps 46 and 48 are pulled tightly together and are secured by a conventional loop and hook fastener 92, with hooks 94 on one flap and loops 96 on the other. Such a fastener is well known under the brand name "VELCRO".

Cinch 20 is used by positioning it to extend beneath the belly of an animal and wityh the lands 24 against the animal and with the buckles 64 and 66 attached to saddle straps (not shown) and, if desired, the rings 78 and 80 attached to other riggings (not shown) placed on the animal.

In the embodiment of FIGS. 10–13 the cinch is shown generally at 100. Cinch 100 comprises an animal engaging strap 102 formed in the manner of previously described animal engagement strap 22, but with a sheet of material 104 stretched between and sewn to top surfaces of each of the peripheral edges 106 and 108 of the animal engaging strap 102. The sheet of material extends over the lands and grooves 24 and 26 of the animal engagement strap 102 until the animal engagement strap 102 is pulled through the sleeve 110 formed by the animal engagement strap 102 and the sheet of material 104, as shown by arrow A. After the animal engagement strap is pulled through the sleeve a buckle strap, which is constructed in the same manner as the buckle strap 50, previously described, is inserted into the sleeve 110 such that the peripheral edges 106 and 108 are turned back over the edges of the buckle strap and the rings 78 and 80 project through slots provided therefore through the sheet of material 104.

The cinch 100 is used in the same manner as cinch 20, previously described.

Although preferred embodiments of my invention have been herein disclosed, it is to be understood that the present disclosure is by way of example and that variations are possible without departing from the subject matter coming within the scope of the following claims, which subject matter I regard as my invention.

I claim:

1. An improved cinch for use with animals comprising an elongate, molded animal engagement strap having a base, a plurality of lands extending transversely across one upper face of the base, said lands having curved adjacent edges at ends remote from said base, spaces between adjacent lands forming grooves for air and moisture to pass through, and a buckle positioning member formed at each end of said animal engagement strap;

an elongate buckle strap having a buckle at each end thereof, positioned against a bottom face of said base, with said buckles each positioned to overlie a buckle positioning member; and securement means holding said buckle strap against said animal engagement strap.

2. An improved cinch as in claim 1, wherein the base of the animal engagement strap has a peripheral flange extending outwardly therefrom and the securement means comprises a pair of flaps extending from the peripheral flange at opposite sides of said flange and from the top surface of said base over said buckle strap to be interlocked with a hook and loop fastener.

3. An improved cinch as in claim 1, wherein the base of the animal engagement strap has a peripheral flange extending outwardly therefrom and the securement means comprises a sheet of material having one side edge secured to the peripheral flange at one side and at the top face of the base and an opposite side edge secured to said peripheral flange at an opposite side and at said top face of said base.

4. A method of making an animal engagement strap for use in a cinch comprising heating, pressurizing and molding an elongate piece of durable plastic foam material to have a plurality of spaced apart lands extending from a base and transversely across said base, each of said lands being curved on the edges thereof remote from said base and the spaces between adjacent lands forming grooves whereby upon bending of said animal engagement strap the curved ends of adjacent ones of said lands are oppositely curved to reduce pinching between said lands.

5. A method as in claim 4, further including forming said animal engagement strap to have a peripheral flange around the base for the attachment of securement means to hold a buckle strap in place against said animal engagement strap.

* * * * *